US008168581B2

(12) United States Patent
Wiedemann

(10) Patent No.: US 8,168,581 B2
(45) Date of Patent: May 1, 2012

(54) PROCESS FOR PRODUCING A MULTI-PHASE DETERGENT TABLET

(75) Inventor: Ralf Wiedemann, Ludwigshafen (DE)

(73) Assignee: Reckitt Benckiser N.V., WT Hoofddorp (NL)

( * ) Notice: Subject to any disclaimer, the term of this patent is extended or adjusted under 35 U.S.C. 154(b) by 212 days.

(21) Appl. No.: 11/570,552

(22) PCT Filed: Jun. 20, 2005

(86) PCT No.: PCT/GB2005/002405

§ 371 (c)(1),
(2), (4) Date: Jan. 10, 2007

(87) PCT Pub. No.: WO2005/123894

PCT Pub. Date: Dec. 29, 2005

(65) Prior Publication Data

US 2009/0018042 A1 Jan. 15, 2009

(30) Foreign Application Priority Data

Jun. 19, 2004 (GB) ..... 0413800.4

(51) Int. Cl.
*C11D 11/00* (2006.01)
*C11D 17/00* (2006.01)
*C11D 17/04* (2006.01)

(52) U.S. Cl. ..... 510/446; 510/224; 510/294; 510/298; 510/439

(58) Field of Classification Search ..... 510/224, 510/446, 298, 294, 439
See application file for complete search history.

(56) References Cited

U.S. PATENT DOCUMENTS

| | | | | |
|---|---|---|---|---|
| 6,391,845 | B1 * | 5/2002 | Speed et al. | 510/446 |
| 6,413,928 | B1 * | 7/2002 | Painter et al. | 510/446 |
| 6,440,927 | B1 * | 8/2002 | Painter et al. | 510/446 |
| 6,451,754 | B1 | 9/2002 | Rowland et al. | |
| 6,486,117 | B1 * | 11/2002 | Painter et al. | 510/446 |
| 6,514,429 | B1 | 2/2003 | Waschenbach et al. | |
| 6,544,944 | B1 * | 4/2003 | Ricci et al. | 510/446 |
| 6,548,473 | B1 * | 4/2003 | Jacques Kamiel Thoen et al. | 510/446 |
| 6,660,704 | B1 | 12/2003 | Waschenbach et al. | |
| 6,730,646 | B1 | 5/2004 | Waschenbach et al. | |
| 7,205,266 | B2 * | 4/2007 | Holderbaum et al. | 510/224 |
| 2003/0119707 | A1 * | 6/2003 | Kosub et al. | 510/446 |
| 2003/0166493 | A1 | 9/2003 | Holderbaum et al. | |
| 2003/0226210 | A1 | 12/2003 | Pacha et al. | |

FOREIGN PATENT DOCUMENTS

| | | | |
|---|---|---|---|
| CA | 2299926 | A1 | 3/2000 |
| CA | 2372193 | A1 | 11/2000 |
| DE | 29612148 | A1 * | 12/1997 |
| DE | 10233832 | A1 | 7/2003 |
| JP | 09175992 | A * | 7/1997 |
| WO | 99/27069 | A | 6/1999 |
| WO | WO 02/26926 | A1 * | 4/2002 |
| WO | WO 02/44316 | A1 * | 6/2002 |

OTHER PUBLICATIONS

English language abstract of DE10233832 obtained online from the European Patent Office web site, esp@cenet, Jul. 2003.

* cited by examiner

*Primary Examiner* — Lorna M Douyon
(74) *Attorney, Agent, or Firm* — Norris McLaughlin & Marcus PA

(57) ABSTRACT

A process for the manufacture of a detergent tablet comprises filling a recess in a first pre-formed body with a gel; adding a second body to the gel; and allowing/causing the gel to solidify.

10 Claims, 1 Drawing Sheet

PROCESS FOR PRODUCING A MULTI-PHASE DETERGENT TABLET

The present invention relates to a process for producing a detergent tablet.

Multi-phase shaped detergent bodies, in particular tablets, having a first shaped detergent portion attached to a second shaped detergent portion are of particular interest in the detergent industry. Usually the second (often smaller) portion is arranged in a recess present in a surface of the first portion.

These kinds of tablets are advantageous for several reasons. Firstly, technically these detergent products allow for the separation of antagonistic detergent components (e.g. bleach and enzyme) and a greater/more sophisticated controlled release of same.

Secondly, aesthetically, these products allow the detergent manufacturer to develop designs which are attractive to a consumer and help to distinguish products on the marketplace.

However, a major disadvantage of multi-phase detergent tablets is that the manufacture of such products requires a highly precise and costly process. This can be appreciated when considering the manufacturing process for the recessed format described above. Here, where both of the portions are pre-formed, the recess of the first portion and the second portion need to be precisely manufacture to assure a good fit both for aesthetic reasons and also to ensure that the portions do not become separated on handling and trans-port of the product.

It is an object of the present invention to overcome/mitigate the problems outlined above.

Figure 1:
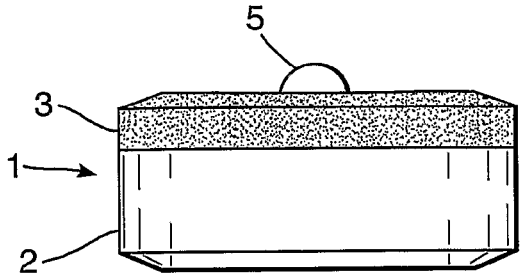
FIG. 1 depicts a side elevation view of a detergent tablet according to the invention.

According to a first aspect of the present invention there is provided a process for the manufacture of a detergent tablet, the process comprising:— a) filling a recess in a first pre-formed body with a gel;

b) adding a second body to the gel; and c) allowing/causing the gel to solidify.

The gel may be added to the recess before/after the second pre-formed body. Clearly if the gel is added before the second pre-formed body then the second pre-formed body is added to the gel before solidification is allowed/caused.

Surprisingly it was found that the shear forces required to separate the bodies of the tablet produced in the process according to the invention were very high. Thus, tablets produced in accordance with the invention provide excellent transport and handling stability.

Additionally it was found that the gel component was able to fine-tune/control the release of actives from the second body.

Moreover the process of the invention allows the formulation of increasingly non-compatible detergent actives in the first and the second shaped bodies, presumably due to the gel acting as a barrier layer between the two shaped detergent bodies.

The tablet is preferably at least partially wrapped in a foil. The foil may extend over a limited part of the tablet, such as over the mouth of the recess, thus enclosing the gel potion and the second body. Alternatively the foil may extend over a larger part of the tablet and, for example, cover the entire surface of the tablet.

The foil may comprise a polymeric material such as those commonly used for wrapping detergent tablets.

Where the tablet is wrapped in a foil it has been found that the tablet has beneficial properties. More specifically it has been observed that, typically as the second body projects above the surface of the gel, the upper surface of the second body provides support for the foil, rather than the gel itself. This has the beneficial effect that the foil wrapper may be applied to the tablet before the gel has solidified without there being any disadvantageous interaction, e.g. such as the formation of an attachment between the gel and the foil. With a tablet in accordance with the present invention the foil wrapper can be applied before the gel has solidified; the gel solidification step can be avoided, thus simplifying the overall tablet manufacturing process.

It is preferred that the second body penetrates the gel such that at least from 20-30% of the volume of the second body is beneath the upper surface of the gel.

Preferably the recess of the first body has a mouth, the area of which is at least 50% larger than the largest diameter of the second body. More preferably the mouth is as least 70% larger and most preferably at least 90% larger.

Generally the recess in the first body has its deepest point in the centre for self positioning of the second shaped body therein. Preferably the recess has a curved shape.

The recess in the first detergent shaped body may be impregnated, coated or foiled to provide a barrier layer to the non-compressed detergent portion.

The first body preferably comprises a plurality of layers, each having a different chemical make-up or different aesthetic.

The first body may comprises a particulate/granular material or a homogeneous solid. Preferably the first body is formed by compaction (suitable for granulates) or injection moulding (suitable for homogenous solids). Generally the first body comprises an admixture of detergent components, e.g. builder, surfactant, binder, enzyme, bleach, pH modifying agent, dye, preservative and perfume.

The second body may comprises a particulate/granular material or a homogeneous solid. Preferably the second body is formed by compaction (suitable for granulates) or injection moulding (suitable for homogenous solids). Generally the first body comprises an admixture of detergent components, e.g. builder, surfactant, binder, enzyme, bleach, pH modifying agent, dye, preservative and perfume.

The gel comprises a liquid, when poured into the cavity. The gel is allowed/caused to harden in the cavity so that it has limited 'flow-ability' after hardening. Hardening may be achieved by, for example, chilling a molten gel, thickening a gel, or by chemical reaction of different components in the cavity of the tablet to create a thickened gel.

The gel preferably comprises a thickening system and optionally other detergent components.

The thickening system typically comprises a non-aqueous liquid diluent and an organic or polymeric gelling additive.

Suitable types of useful liquid diluents include alkylene glycol mono lower alkyl ethers, propylene glycols, ethoxylated or propoxylated ethylene or propylene, glycerol esters, glycerol triacetate, lower molecular weight polyethylene glycols, lower molecular weight methyl esters, amides and preferably non-ionic surfactants.

A preferred type of liquid diluent comprises the mono-, di-, tri-, or tetra-$C_2$-$C_3$ alkylene glycol mono $C_2$-$C_6$ alkyl ethers. Specific examples of such compounds include di-ethylene glycol monobutyl ether, tetraethylene glycol mono-butyl ether, dipropylene glycol monoethyl ether, and dipropylene glycol monobutyl ether. Diethylene glycol mono butyl ether and dipropylene glycol monobutyl ether are especially preferred. Compounds of the type have been commercially marketed under the tradenames Dowanol, Carbitol, and Cellosolve.

Another preferred type of liquid diluent comprises the lower molecular weight polyethylene glycols (PEGs). Such materials are those having molecular weights of at least 150. PEGs of molecular weight ranging from 200 to 600 are most preferred.

Yet another preferred type of liquid diluent comprises lower molecular weight methyl esters. Such materials are those of the general formula: R—C(O)—$OCH_3$ wherein R ranges from 1 to 18. Examples of suitable lower molecular weight methyl esters include methyl acetate, methyl propionate, methyl octanoate, and methyl dodecanoate.

Examples of nonionic surfactants are fatty acid alkoxylates, such as fatty acid ethoxylates, especially those of formula:

$$R(C_2H_4O)_nOH$$

wherein R is a straight or branched $C_8$-$C_{16}$ alkyl group, preferably a $C_9$-$C_{15}$, for example $C_{10}$-$C_{14}$, alkyl group and n is at least 1, for example from 1 to 16, preferably 2 to 12, more preferably 3 to 10.

The alkoxylated fatty alcohol nonionic surfactant will frequently have a hydrophilic-lipophilic balance (HLB) which ranges from 3 to 17, more preferably from 6 to 15, most preferably from 10 to 15.

Examples of fatty alcohol ethoxylates are those made from alcohols of 12 to 15 carbon atoms and which contain about 7 moles of ethylene oxide. Such materials are commercially marketed under the trademarks Neodol 25-7 and Neodol 23-6.5 by Shell Chemical Company. Other useful Neodols include Neodol 1-5, an ethoxylated fatty alcohol averaging 11 carbon atoms in its alkyl chain with about 5 moles of ethylene oxide; Neodol 23-9, an ethoxylated primary $C_{12}$-$C_{13}$ alcohol having about 9 moles of ethylene oxide; and Neodol 91-10, an ethoxylated $C_9$-$C_{11}$ primary alcohol having about 10 moles of ethylene oxide.

Alcohol ethoxylates of this type have also been marketed by Shell Chemical Company under the Dobanol trademark. Dobanol 91-5 is an ethoxylated $C_9$-$C_{11}$ fatty alcohol with an average of 5 moles ethylene oxide and Dobanol 25-7 is an ethoxylated $C_{12}$-$C_{15}$ fatty alcohol with an average of 7 moles of ethylene oxide per mole of fatty alcohol.

Other examples of suitable ethoxylated alcohol nonionic surfactants include Tergitol 15-S-7 and Tergitol 15-S-9, both of which are linear secondary alcohol ethoxylates available from Union Carbide Corporation. Tergitol 15-S-7 is a mixed ethoxylated product of a $C_{11}$-$C_{15}$ linear secondary alkanol with 7 moles of ethylene oxide and Tergitol 15-S-9 is the same but with 9 moles of ethylene oxide.

Other suitable alcohol ethoxylated nonionic surfactants are Neodol 45-11, which is a similar ethylene oxide condensation products of a fatty alcohol having 14-15 carbon atoms and the number of ethylene oxide groups per mole being about 11. Such products are also available from Shell Chemical Company.

Further nonionic surfactants are, for example, $C_{10}$-$C_{18}$ alkyl polyglycosides, such s $C_{12}$-$C_{16}$ alkyl polyglycosides, especially the polyglucosides. These are especially useful when high foaming compositions are desired. Further surfactants are polyhydroxy fatty acid amides, such as $C_{10}$-$C_{18}$ N-(3-methoxypropyl) glycamides and ethylene oxide-propylene oxide block polymers of the Pluronic type.

The liquid diluent preferably comprises from 10 wt % to 60 wt % of the gel portion, more preferably 20 wt % to 50 wt %, most preferably from 30 wt % to 50 wt %.

For suitable gel stability and rheology, the organic gelling agent is generally present to the extent of a ratio of solvent to gelling agent in thickening system typically ranging from 99:1 to 1:1. More preferably, the ratios range from 19:1 to 4:1.

The preferred gelling agents are selected from castor oil derivatives, polyethylene glycol, sorbitols and related organic thixatropes, organoclays, cellulose and cellulose derivatives, pluronics, stearates and stearate derivatives, sugar/gelatin combination, starches, glycerol and derivatives thereof, organic acid amides such as N-lauryl-L-glutamic acid di-n-butyl amide, polyvinyl pyrrolidone and mixtures thereof.

Polyethylene glycols when employed as gelling agents, rather than solvents, are low molecular weight materials, having a molecular weight range of from 1000 to 10,000, with 3,000 to 8,000 being the most preferred.

Cellulose and cellulose derivatives when employed preferably include: i) Cellulose acetate and Cellulose acetate phthalate (CAP); ii) Hydroxypropyl Methyl Cellulose (HPMC); iii) Carboxy methylcellulose (CMC); and mixtures thereof.

The sugar may be any monosaccharide (e.g. glucose), disaccharide (e.g. sucrose or maltose) or polysaccharide. The most preferred sugar is sucrose.

Type A or B gelatin may be used. Type A gelatin is preferred.

The gel may comprise solid ingredients to aid in the control of the viscosity of the gel in conjunction with the thickening system. Solid ingredients may also act to optionally disrupt the gel thereby aiding dissolution of the gel. When included, the gel portion comprises 15% or more solid ingredients, more preferably at least 30% solid ingredients and most preferably at least 40% solid ingredients. However, due to the need to be able to pump and otherwise process the gel, the gel typically does not include more than 90% solid ingredients.

The gel may include other auxiliary components such as dyes and/or structure modifying agents.

Structure modifying agents include various polymers and mixtures of polymers including polycarboxylates, carboxymethylcelluloses and starches to aid in adsorption of excess liquid diluent and/or reduce or prevent "bleeding" or leaking of the liquid diluent from the gel, reduce shrinkage or cracking of the gel portion or aid in the dissolution or break-up of the gel portion in the wash.

Hardness modifying agents may incorporated into the thickening system to adjust the hardness of the gel if desired. These hardness control agents are typically selected from various polymers, such as polyethylene glycol's, polyethylene oxide, polyvinylpyrrolidone, polyvinyl alcohol, hydroxystearic acid and polyacetic acid and when included are typically employed in levels of less than 20% and more preferably less than 10% by weight of the solvent in the thickening system.

The density of the gel is generally from 0.7 g/cm$^3$ to 2.0 g/cm$^3$, more preferably from 0.9 g/cm$^3$ to 1.8 g/cm$^3$, most preferably from 1.1 g/cm$^3$ to 1.6 g/cm$^3$.

According to a second aspect of the present invention there is provided a detergent tablet, the tablet comprising a first pre-formed body having a recess, filled with a gel and a second body partially submerged in the gel.

The features of the first aspect of the present invention shall apply mutatis mutandids to the second aspect of the invention.

The tablet is preferably for use in an automatic dishwashing process.

The invention will now be illustrated further by reference to the following non-limiting Examples.

EXAMPLE 1

Automatic Dishwashing Tablet

A 2-layer tablet having a cavity is manufactured by pre-compressing the first layer with 200 kg/cm$^2$ and a final compression of 800 kg/cm$^2$. The dimensions of the tablet were length 36 mm; width: 26 mm; height 15 mm; weight 20.0 g.

Formulation for a 2-layer dishwashing tablet:

| Component | Total (wt %) | Lower Layer (70%) | Upper Layer (30%) |
|---|---|---|---|
| Sodium perborate | 10.50 | 15.00 | — |
| Sodium tripolyphosphate | 43.81 | 43.30 | 45.00 |
| Silicate | 3.50 | 5.00 | — |
| Sodium bicarbonate | 0.30 | — | 1.00 |
| Sodium carbonate | 28.11 | 26.70 | 31.40 |
| Polyethyleneglycol | 6.00 | 6.00 | 6.0 |
| Polycarboxylate | 0.60 | — | 2.00 |
| TAED | 2.55 | — | 8.50 |
| Amylase | 0.45 | — | 1.50 |
| Protease | 0.75 | — | 2.50 |
| Dye | 0.03 | — | 0.10 |
| Nonionic | 3.05 | 3.50 | 2.00 |
| Silver corrosion inhibitor | 0.28 | 0.4 | — |
| Perfume | 0.07 | 0.10 | — |
| | 100.00 | 100.00 | 100.00 |

A pill is manufactured by compressing the below formula with a compression of 1000 kg/cm$^2$ (diameter 13.0 mm; height 8 mm; weight 2.2 g).

| Component | Wt % |
|---|---|
| Lactose | 42.5 |
| Microcrystalline cellulose | 20.5 |
| Polyvinylpyrolidone | 2.0 |
| Phosphonate | 6.0 |
| Cold water active protease | 13.0 |
| Cold water active amylase | 15.0 |
| Mg-stearate | 0.5 |
| dye | 0.5 |
| | 100.0 |

Gel is manufactured according to the formula below:

| Component | Wt % |
|---|---|
| Nonionic surfactant | 34.5 |
| Sodium tripolyphosphate | 49.5 |
| Polyethyleneglycol (300) | 15.0 |
| Polyethyleneglycol (35000) | 1.0 |
| | 100.0 |

The gel mixture is heated to 100° C. and stirred for 15 min. Into the cavity of the 2-layer tablet 4g of gel are filled at 90° C. The pill is added to the cavity and is allowed to partly immerse in the gel. Then the gel is allowed to chill and solidify.

EXAMPLE 2

Automatic Dishwashing Tablet

A 2-layer tablet is manufactured as described in Example 1.

Formulation for a 2-layer dishwashing tablet:

| Component | Total (wt %) | Lower Layer (70%) | Upper Layer (30%) |
|---|---|---|---|
| Sodium perborate | 10.50 | 15.00 | — |
| Sodium tripolyphosphate | 45.91 | 43.30 | 52.00 |
| Silicate | 3.50 | 5.00 | — |
| Sodium bicarbonate | 0.30 | — | 1.00 |
| Sodium carbonate | 27.81 | 26.70 | 30.40 |
| Polyethyleneglycol | 6.00 | 6.00 | 6.0 |
| Polycarboxylate | 1.05 | — | 3.50 |
| Amylase | 0.45 | — | 1.50 |
| Protease | 0.75 | — | 2.50 |
| Dye | 0.03 | — | 0.10 |
| Nonionic | 3.05 | 3.50 | 2.00 |
| Antifoam | 0.30 | — | 1.00 |
| Silver corrosion inhibitor | 0.28 | 0.4 | — |
| Perfume | 0.07 | 0.10 | — |
| | 100.00 | 100.00 | 100.00 |

A pill is manufactured by compressing the below formula with a compression of 1500 kg/cm$^2$ (diameter 13.0 mm; height 8 mm; weight 2.4 g).

| Component | Wt % |
|---|---|
| Lactose | 28.0 |
| Microcrystaline cellulose | 10.5 |
| Polyvinylpyrolidone | 2.0 |
| Phosphonate | 6.0 |
| TAED | 52.5 |
| Mg-stearate | 0.5 |
| dye | 0.5 |
| | 100.0 |

Gel is manufactured according to the formula below:

| Component | Wt % |
|---|---|
| Nonionic surfactant | 71.0 |
| Polyethyleneglycol (6000) | 29.0 |
| | 100.0 |

The gel mixture is heated to 80° C. and stirred for 15 min. Into the cavity of the 2-layer tablet 3g of gel are filled at 70° C. The pill is added to the cavity and is allowed to partly immerse in the gel. Then the gel is allowed to chill and solidify.

EXAMPLE 3

Automatic Dishwashing Tablet

A mono-layer tablet having a cavity is manufactured by compression at 1000 kg/cm$^2$. The dimensions of the tablet were length 36 mm; width: 26 mm; height 15 mm; weight 20.0 g.

Formulation for a 2-layer dishwashing tablet:

| Component | Wt % |
|---|---|
| Sodium perborate | 10.50 |
| Sodium tripolyphosphate | 48.00 |
| Silicate | 3.50 |
| Sodium bicarbonate | 0.50 |
| Sodium carbonate | 22.80 |
| Polyethyleneglycol | 6.00 |
| Polycarboxylate | 1.00 |
| TAED | 3.00 |
| Amylase | 0.50 |
| Protease | 0.70 |
| Dye | 0.10 |
| Nonionic | 3.00 |
| Silver corrosion inhibitor | 0.30 |
| Perfume | 0.10 |
| | 100.00 |

A pill is manufactured by casting the formula into a spherical mould at 100° C. and allowing it to chill (diameter 11.0 mm; weight 0.8 g). The pill is then coated in a film coater with polyvinyl alcohol.

| Component | Wt % |
|---|---|
| Nonionic surfactant | 45.0 |
| Polyethyleneglycol (35000) | 53.0 |
| Polyvinyl alcohol | 2.0 |
| | 100.0 |

Gel is manufactured according to the formula below:

| Component | Wt % |
|---|---|
| Nonionic surfactant | 10.0 |
| Trisodium citrate | 19.4 |
| Glycerine | 64.8 |
| Amylase | 0.8 |
| Gelatine | 5.0 |
| | 100.0 |

The gel mixture is heated to 100° C. and stirred for 15 min. Into the cavity of the 2-layer tablet 3g of gel are filled at 90° C. The pill is added to the cavity and is allowed to partly immerse in the gel. Then the gel is allowed to chill and solidify.

EXAMPLE 4

Automatic Laundry Tablet

A 2-layer tablet having a cavity is manufactured by pre-compressing the first layer with 5 kg/cm$^2$ and a final compression of 300 kg/cm$^2$. The dimensions of the tablet were diameter 45 mm; height 22 mm; weight 40.0 g.

Formulation for a 2-layer dishwashing tablet:

| Component | Lower Layer (70%) | Upper Layer (30%) |
|---|---|---|
| LAS | 12.50 | 13.00 |
| Soap | 1.25 | 1.20 |
| Alkylsulphate | 2.05 | 3.50 |
| Phosponate | 0.50 | 1.00 |
| Polymer | 2.30 | 2.30 |
| Zeolite | 5.50 | 6.50 |
| Sodium Carbonate | 19.00 | 17.00 |
| Sodium Carbonate-carboxymethyl cellulose | 0.30 | 0.30 |
| Sodium Sulphate | 3.00 | 2.74 |
| Sodium Silicate | 2.00 | 1.00 |
| Amorphous Silicate | 8.00 | 13.00 |
| Antifoam | 0.50 | 0.30 |
| Disintegrant | 10.00 | 10.00 |
| Polyethyleneglycol | — | 1.00 |
| Dye | — | 0.01 |
| Protease | — | 2.70 |
| Amylase | — | 1.70 |
| Percarbonate | 30.00 | — |
| TAED | — | 18.00 |
| Brightener | 0.30 | 0.25 |
| Fragrance | 0.30 | — |
| Water | 2.50 | 4.50 |
| | 100.00 | 100.00 |

A pill is manufactured by compressing the below formula with a compression of 1000 kg/cm$^2$ (diameter 13.0 mm; height 8 mm; weight 2.2 g).

| Component | Wt % |
|---|---|
| Lactose | 42.5 |
| Microcrystaline cellulose | 20.5 |
| Crosslinked polyvinylpyrolidone | 2.0 |
| Phosphonate | 6.0 |
| Cold water active protease | 13.00 |
| Cold water active amylase | 15.00 |
| Mg-stearate | 0.5 |
| dye | 0.5 |
| | 100.0 |

Gel is manufactured according to the formula below:

| Component | Wt % |
|---|---|
| Nonionic surfactant | 71.0 |
| Polyethyleneglycol (6000) | 29.0 |
| | 100.0 |

The gel mixture is heated to 80° C. and stirred for 15 min. Into the cavity of the 2-layer tablet 3g of gel are filled at 70° C. The pill is added to the cavity and is allowed to partly immerse in the gel. Then the gel is allowed to chill and solidify.

The invention will now be further illustrated with reference to FIGS. 1 to 5.

Figure 2:
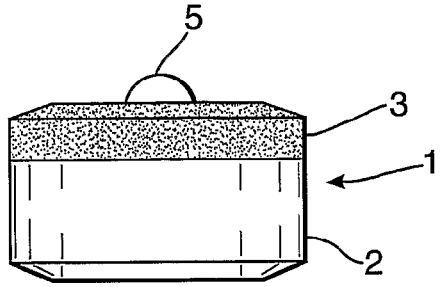
FIG. 2 depicts a side elevation view of the detergent tablet of FIG. 1.
Figure 3:
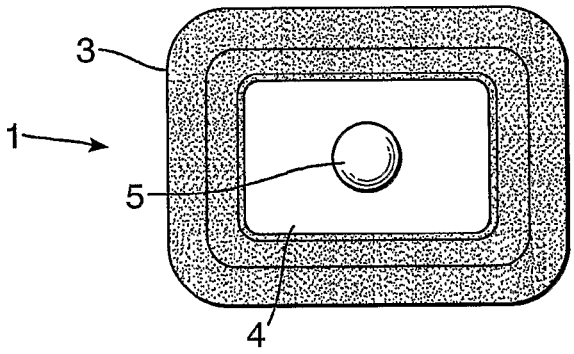
FIG. 3 depicts a top plan view of the detergent tablet of FIG. 1.
Figure 4:
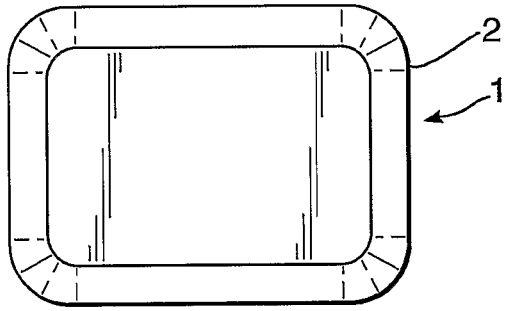
FIG. 4 depicts a bottom plan view of the detergent tablet of FIG. 1.
Figure 5:
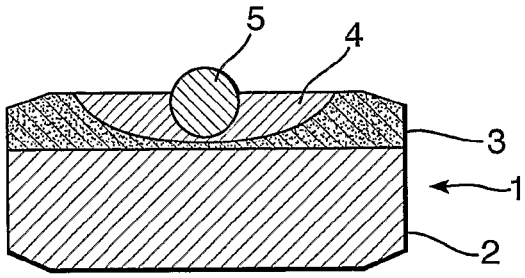
FIG. 5 depicts a cross-sectional view of the detergent tablet of FIG. 1.

FIGS. 1 and 2 (both side views), 3 (plan view), 3 (underneath view) and 5 (cross-section) show a tablet 1 of the present invention.

The tablet 1 comprises a bottom layer 2 and an upper layer 3, each formed from a compacted particulate composition (which is usually different for each layer).

The upper layer 2 has an indentation 3. The indentation is formed in the compression process.

Present within the indention 3 is a solidified gel 4 which retains a solid body 5, partially submerged therein.

It would also be conceivable to use a single layer tablet. Further it would be conceivable to use a multi-layer tablet wherein the layers are not strictly planar but one layer projects into a recess of a neighbouring layer.

It is obvious for someone skilled in the art that there are more and other embodiments of the article of the present application achieving the basic feature of the invention.

The features disclosed in the foregoing description, in the claims and/or drawings may, both separately and in any combination thereof be material for realising the invention in diverse forms thereof.

The invention claimed is:

1. A process for the manufacture of a detergent tablet, wherein said process comprises the steps of:

forming a first body which includes a recess therein;

forming a second body by compaction or injection molding;

providing a gel comprising a non-aqueous liquid diluent into the recess of the pre-formed, first body;

providing the pre-formed, second body to the gel wherein at least 20% of the volume of the second body is beneath the upper surface of the gel; and allowing or causing the gel to solidify wherein the second body is only partially submerged in the solidified gel, and, only partially wrapping the tablet with foil wrapper before the gel is solidified.

2. A process according to claim 1, wherein the recess of the first body has a mouth, the area of which is at least 50% larger than the largest diameter of the second body.

3. A process according to claim 1, wherein the recess in the first body has its deepest point in the centre.

4. A process according to claim 1, wherein the recess in the first body is impregnated, coated or foiled.

5. A process according to claim 1, wherein the second body is a compressed pill.

6. A process according to claim 1, wherein the gel forms a barrier layer between the first body and the second body.

7. A process according to claim 1, wherein said non-aqueous liquid diluent comprises from 10% wt. to 60% wt. of said gel.

8. A process according to claim 7, wherein said non-aqueous liquid diluent comprises from 20% wt. to 50% wt. of said gel.

9. A process according to claim 1, wherein said non-aqueous liquid diluent and said organic or polymeric gelling additive are present in a respective weight ratios from 99:1 to 1.1.

10. A process according to claim 9, wherein said non-aqueous liquid diluent and said organic or polymeric gelling additive are present in a respective weight ratios from 19:1 to 4:1.

* * * * *